US010194718B2

(12) United States Patent
Raccosta

(10) Patent No.: US 10,194,718 B2
(45) Date of Patent: Feb. 5, 2019

(54) SNAP FASTENER WITH A DIFFERENTIATED BUTTONING AND UNBUTTONING EFFORT FEMALE PART

(71) Applicant: FIMMA S.P.A., Osnago (LC) (IT)

(72) Inventor: Gaetano Raccosta, Osnago (IT)

(73) Assignee: FIMMA S.P.A., Osnago (LC) (IT)

( * ) Notice: Subject to any disclaimer, the term of this patent is extended or adjusted under 35 U.S.C. 154(b) by 268 days.

(21) Appl. No.: 14/708,216

(22) Filed: May 9, 2015

(65) Prior Publication Data

US 2015/0320151 A1 Nov. 12, 2015

(30) Foreign Application Priority Data

May 9, 2014 (IT) ..... MI2014A0844

(51) Int. Cl.
*A44B 17/00* (2006.01)

(52) U.S. Cl.
CPC ..... *A44B 17/0011* (2013.01); *A44B 17/0017* (2013.01); *A44B 17/0041* (2013.01); *A44B 17/0058* (2013.01); *A44B 17/0076* (2013.01); *A44B 17/0088* (2013.01); *Y10T 24/45607* (2015.01); *Y10T 24/45791* (2015.01)

(58) Field of Classification Search
CPC ..... A44B 17/0011; A44B 17/0017; A44B 17/0041; A44B 17/0058; A44B 17/0076; A44B 17/0088; Y10T 24/45607; Y10T 24/45791; Y10T 24/45775
See application file for complete search history.

(56) References Cited

U.S. PATENT DOCUMENTS 1,880,317 A 10/1932 Dews
2,134,037 A * 10/1938 Fenton ..... A44B 17/0011 24/674
5,435,043 A * 7/1995 Ito ..... A41H 37/04 24/114.4

(Continued)

FOREIGN PATENT DOCUMENTS

DE 2259252 A1 * 6/1974 ..... A44B 17/0023
EP 2401934 A1 1/2012
EP 2441340 A1 4/2012

OTHER PUBLICATIONS

Italian Search Report dated Jan. 13, 2015.

*Primary Examiner* — Victor D Batson
*Assistant Examiner* — Matthew J Sullivan
(74) *Attorney, Agent, or Firm* — Hedman & Costigan, P.C.; James V. Costigan; Kathleen A. Costigan

(57) ABSTRACT

A snap fastener, of the type comprising a female part (2) including a spring (11, 11*a*, 11*b*) and a male part (4) including a stem (5) for engagement with the spring, wherein a chamber (10, 10*a*, 10*b*) is provided for housing the spring and including shoulders (12, 12*a*, 12*b*) on a buttoning side, the shoulders having a length (L1) longer than a length (L2) of shoulders (13, 13*a*, 13*b*) arranged on the opposite side. Thus, a differentiated effort buttoning and unbuttoning mechanism between the stem (5) and the spring (11) is achieved. With respect to prior snap fasteners, the inventive snap fastener provides the advantage of requiring very small buttoning efforts, much smaller than those necessary for unbuttoning the snap fastener, thereby facilitating the snap fastener closing operation while providing a tightness closure upon having buttoned the snap fastener male and female parts.

5 Claims, 7 Drawing Sheets

(56) References Cited

U.S. PATENT DOCUMENTS

| | | | | | |
|---|---|---|---|---|---|
| 6,067,694 | A * | 5/2000 | Candotti | A44B 17/0011 | 24/104 |
| 6,076,240 | A * | 6/2000 | Henzler | A44B 17/0011 | 24/661 |
| 9,474,337 | B2 * | 10/2016 | Violato | A44B 17/0076 | |
| 9,504,294 | B2 * | 11/2016 | Hasegawa | A44B 17/0076 | |
| 9,622,549 | B2 * | 4/2017 | Brigato | A44B 17/0041 | |
| 2007/0193006 | A1 | 8/2007 | Kitano | | |
| 2014/0109352 | A1 | 4/2014 | Violato | | |
| 2015/0096156 | A1 * | 4/2015 | Brezzi | A44B 17/0041 | 24/662 |

* cited by examiner

SNAP FASTENER WITH A DIFFERENTIATED BUTTONING AND UNBUTTONING EFFORT FEMALE PART

BACKGROUND OF THE INVENTION

The present invention relates to a snap fastener with a differentiated buttoning and unbuttoning effort female part.

The field of the invention is that of the automatic snap fasteners, in which the stem of the snap fastener male part is engaged in the snap fastener female part and is held therein by a holding spring.

In such a device, it is necessary to provide a given resistance of snap fastener against its "opening" or unbuttoning, without however hindering the buttoning up operation which, on the contrary, should be as fast and easy as possible.

Commercially available snap fasteners do not provide any difference between the buttoning up and unbuttoning effort, thereby the effort required to open or unbutton the snap fastener is normally about the same as that necessary for closing or buttoning it.

The above prior snap fasteners, however, have the drawback that, since the snap fastener should provide a firm tightness after its closure, the buttoning effort is a comparatively high one, thereby rendering the snap fastener closing or buttoning operation a rather difficult one, mainly at positions without a biasing abutment or with a yielding abutment.

Document US 2014/109352 A1 discloses a snap fastener, wherein the opposite shoulders of a chamber including the snap fastener female part spring have a substantially like length, thereby the engaging of snap fastener stem in the female part causes an exclusively radially extending deformation of the spring.

Document EP 2 441 340 A1 discloses a snap fastener including a spring housed in a chamber, which chamber has, in turn, a shoulder on a buttoning side which is shorter than a corresponding shoulder on the opposite side. Since this prior snap fastener requires a comparatively high closing or buttoning effort, said spring is formed with built-in resilient deformable tongues so designed as to facilitate the snap fastener closing operation, while having however the disadvantage of reducing the snap fastener tightness or effort against an accidental and undesired opening thereof.

SUMMARY OF THE INVENTION

Accordingly, the main object of the present invention is to provide a novel snap fastener which, differently from prior like fasteners, facilitates the buttoning operations without negatively affecting its tightness in its closing or buttoned up condition.

Another object of the invention is to provide such a snap fastener of a simple construction and small thickness, which may be easily made with low making costs.

The above mentioned and yet other objects are achieved by the inventive snap fastener according to claim 1.

Preferred embodiments of the invention are claimed in the subclaims.

With respect to prior snap fasteners, the inventive snap fastener provides the advantage that it requires a very small buttoning up effort, much smaller than that necessary for unbuttoning it.

Thus, the snap fastener closing or buttoning up operations are simplified and facilitated, while providing a tight closure after having buttoned up the snap fastener male and female parts.

BRIEF DESCRIPTION OF THE DRAWINGS

The above and yet other objects, advantages and features of the invention will become more apparent from the following disclosure of preferred embodiments of the invention which is illustrated, by way of non-limitative examples, in the figures of the accompanying drawings, where.

DESCRIPTION OF THE PREFERRED EMBODIMENTS

Figure 1:
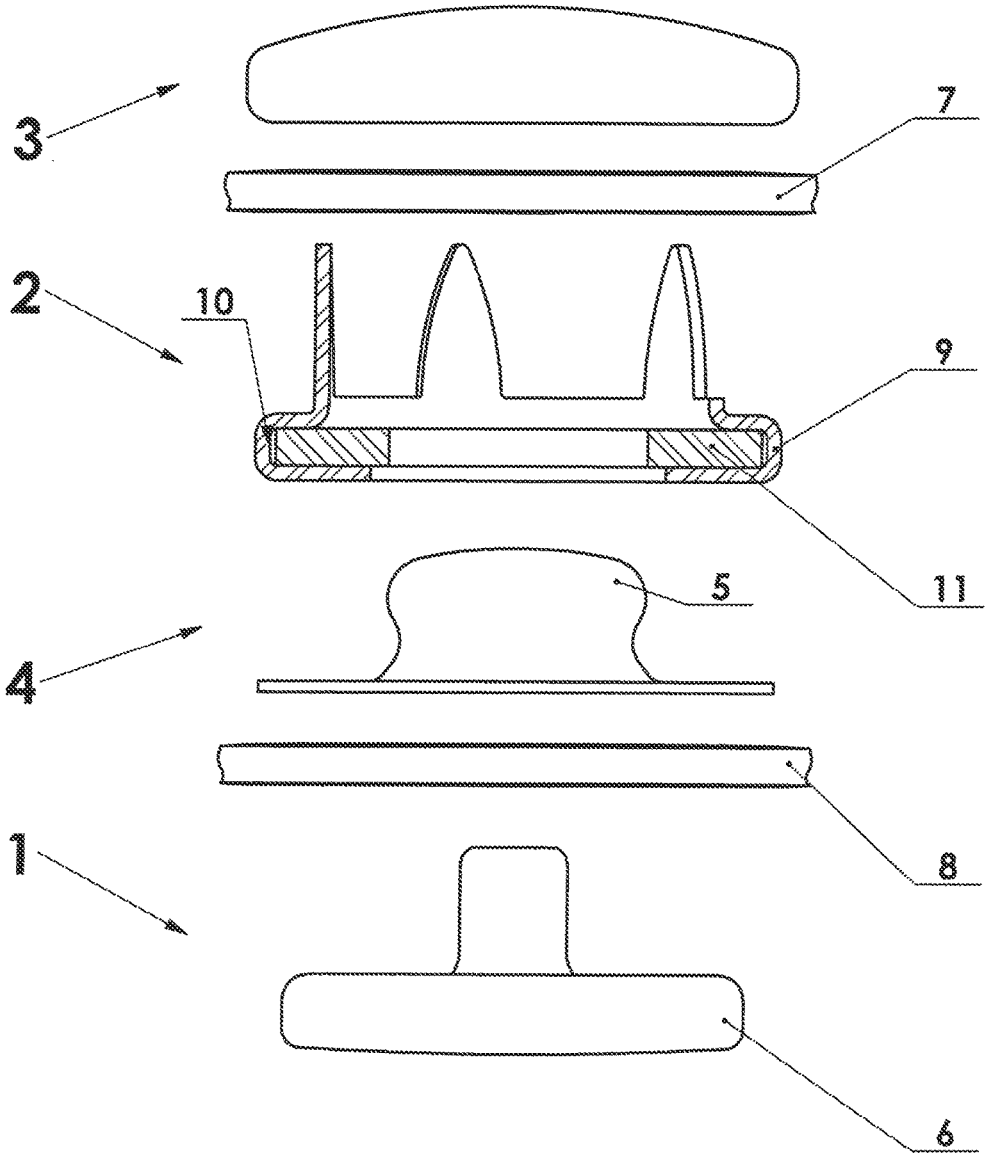
FIG. 1 is an exploded cross-sectional view of a first embodiment of the snap fastener according to the present invention.
Figure 2:
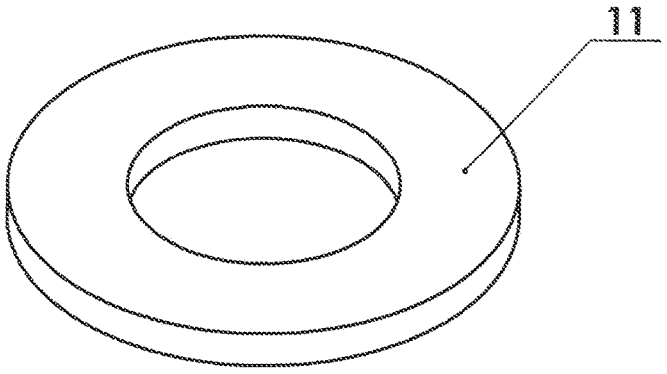
FIG. 2 is a perspective view showing a ring or annular spring of the female part of the snap fastener shown in FIG. 1.

The snap fastener according to the invention, which has been generally indicated by the reference number 1 in FIG. 1, comprises a snap fastener female part 2 clamped on a first support flap 7 (either of a fabric or other material) by a clamping head 3.

A snap fastener 1 male part 4 cooperates with the above female part 2, said male part including in turn a male part stem 5 and being clamped on a second support 8 by a clamping element 6.

Figure 3:
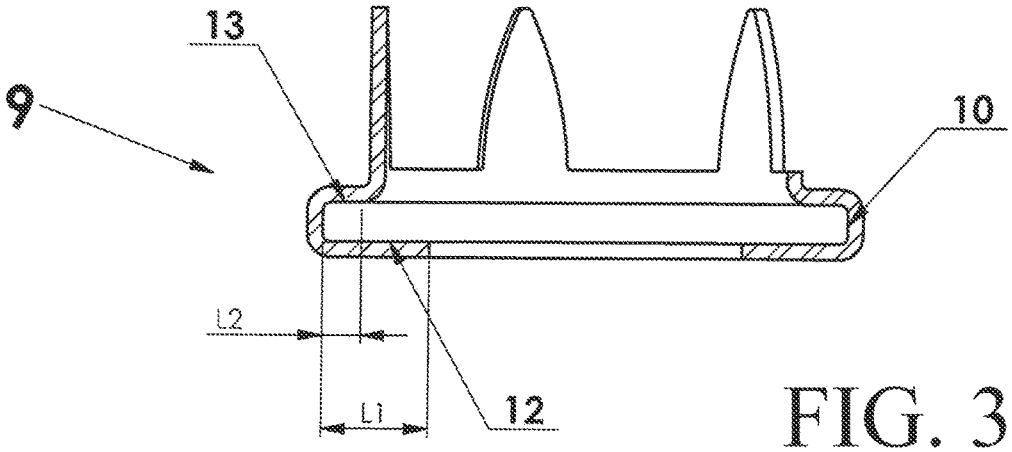
FIG. 3 shows a detail of a cap-shaped body of the female part of the snap fastener shown in FIG. 1.
Figure 4:
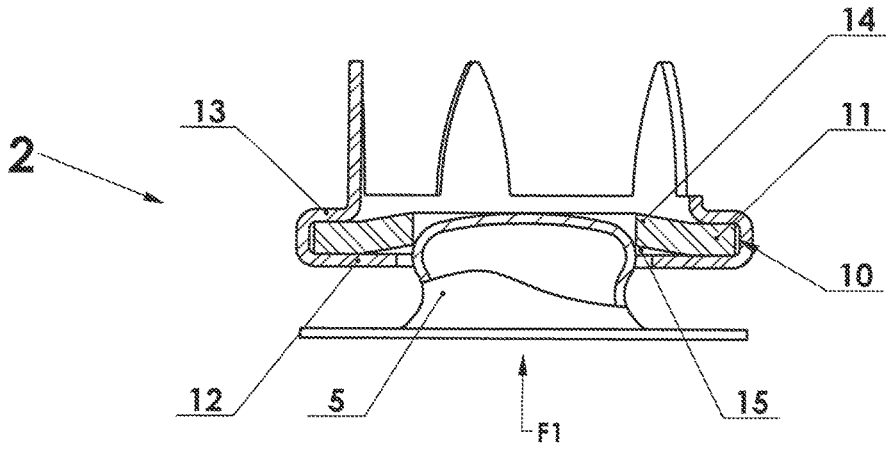
FIGS. 4 and 5 show the snap fastener of FIG. 1, during its buttoning up and unbuttoning operations, respectively.

As clearly shown in FIGS. 3 and 4, the chamber 10 of the cap-shaped body 9 comprises a longer chamber shoulder 12, on the male part engaging; side, said shoulder having a first length L1, as well as a further shorter chamber shoulder 13, on the opposite side, having a second length L2, said length L1 being longer than said length L2.

The above different lengths of the shoulders 12 and of the cap-shaped body 9 provide the spring 11, housed in the chamber 10, with corresponding spring free portions, i.e. a longer spring free portion 14 on the shoulder 13 side and a shorter spring portion 15 on the shoulder 12 side, respectively.

The above different lengths of the shoulders 12 and 13 of the cap-shaped body 9 provide the spring 11, housed in the chamber 10, with corresponding spring free portions, i.e. a longer portion 14 on the shoulder 13 side and a shorter portion 15 on the shoulder 12 side, respectively.

Figure 5:
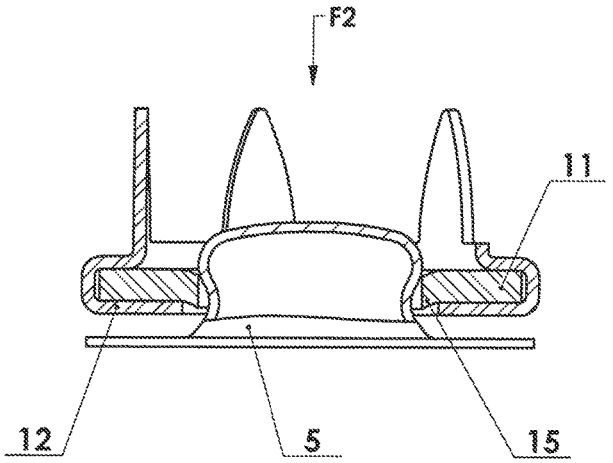

Thus, in the above embodiment and as is shown in FIGS. 4 and 5, a deformation of the spring 11 as the stem 5 is engaged in the female part 2 (see the arrow F1 in FIG. 4) is facilitated by the longer length of the free portion 14 of said spring 11.

On the contrary, the shorter length of the free portion 15 of said spring 11, on the stem 5 engaging side, will provide an enhanced or higher resistance against an unbuttoning (see the arrow F2 in FIG. 5), thereby differentiating from the smaller effort required for the buttoning up operation.

Figure 9:
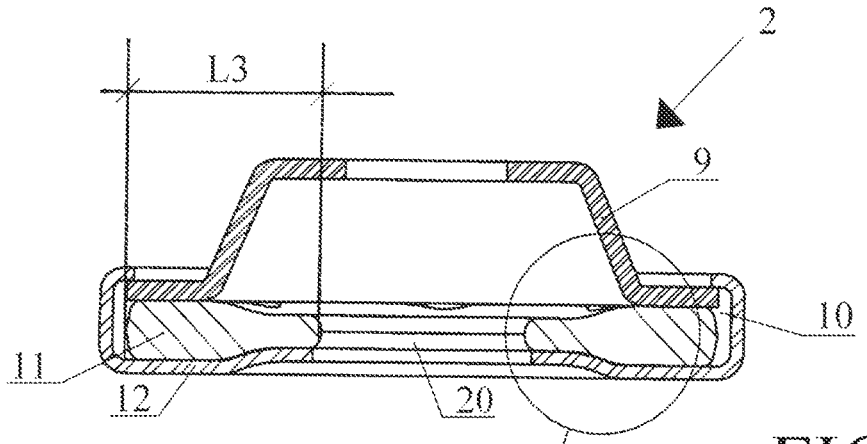
FIGS. 9 and 10 show a further modified embodiment of the snap fastener according to the invention.
Figure 10:
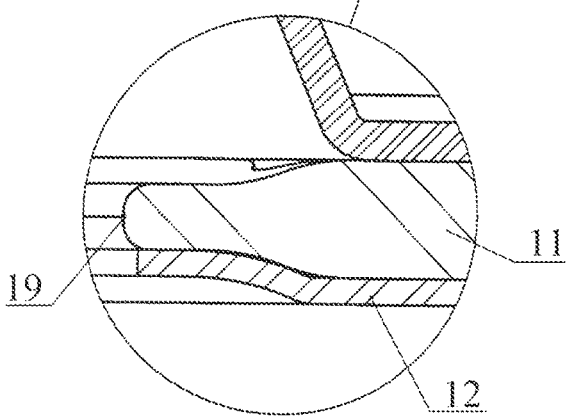

Advantageously, and us is clearly shown in FIGS. 9 and 10, the third length L3 of the annular spring 11 is substantially equal to the first length L1 of the shoulder 12 or the chamber 10 of the cap-shaped body 9 of the inventive snap fastener female part 2, and projects from said shoulder 12 only at an edge 19 of an inner hole 20 of said annular spring 11. Thus, the first length L1 of the shoulder 12 longer chamber covering the spring 11 will stiffen said spring, allowing it to efficiently hinder any unbuttoning effort. On the other hand, in the buttoning up operation, the stem 5 of the snap fastener male part will contact the free edge 19 of the spring 11, thereby facilitating a mutual centering and coupling thereof.

Figure 6:
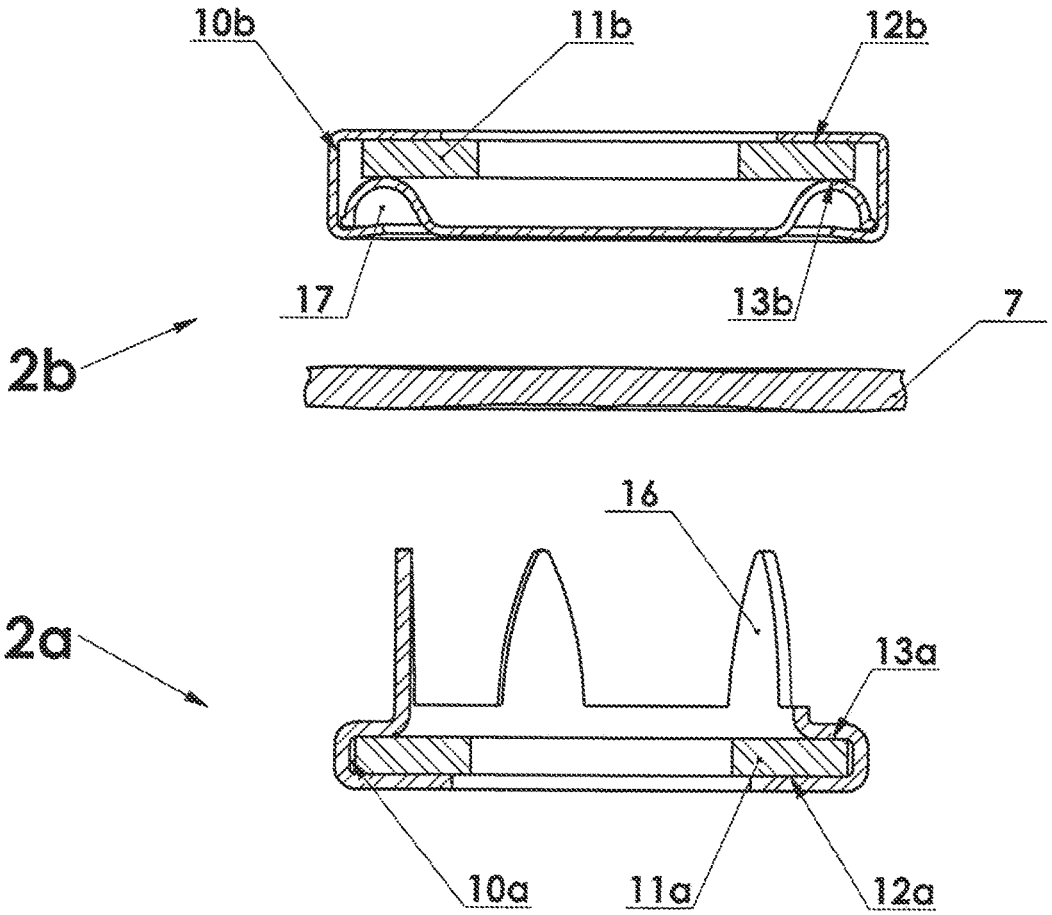
FIG. 6 is an exploded cross-sectional view showing the female part of a snap fastener including two female components.
Figure 7:
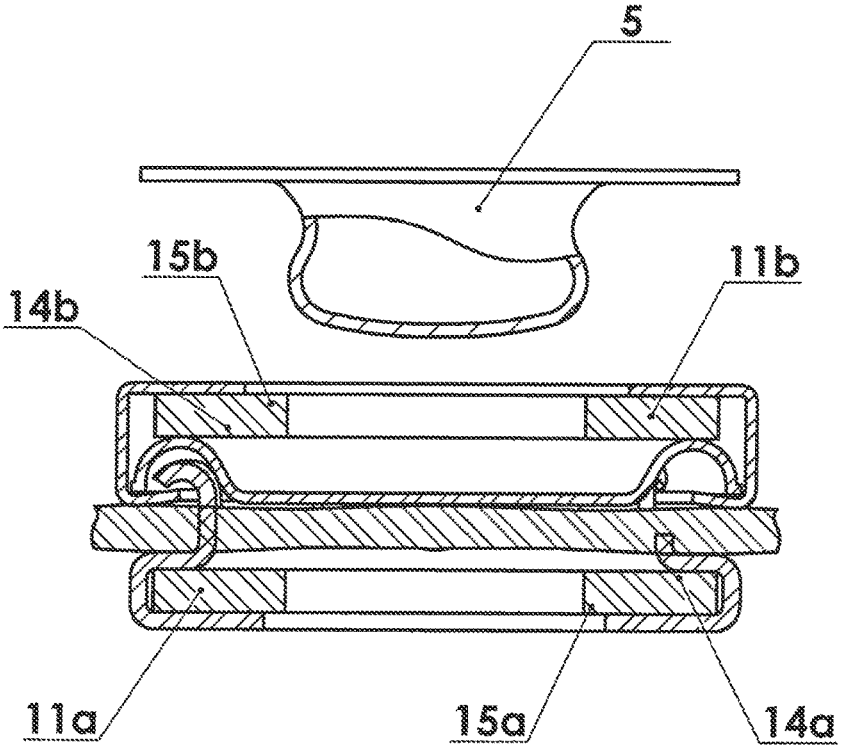
FIG. 7 shows the snap fastener including the female part shown in FIG. 6.

In the modified embodiment shown in FIGS. 6 and 7, the female part 2 comprises two female bodies 2*a*, 2*b* which may be coupled to one another by pointed portions or tips 16 of the body 2*a* which are clamped within corresponding seats 17 of the body 2*b*.

Each said female body 2*a*, 2*b* forms in turn an inner chamber 10*a*, 10*b* for housing a corresponding spring 11*a*, 11*b*.

Said chambers 10*a*, 10*b* are also provided with different length shoulders, i.e. longer chamber shoulders 12*a*, 12*b* on the buttoning side and shorter chamber shoulders 13*a*, 13*b* on the opposite side, respectively.

The above configuration will in turn provide on the respective springs 11*a*, 11*b* longer spring free portions 14*a*, 14*b* and shorter spring free portions 15*a*, 15*b*, with the operating effects as previously disclosed with reference to the embodiments of FIGS. 4 and 5.

The invention, as above disclosed, is susceptible to several modifications and variations all coming within the scope of the following claims.

Figure 8:
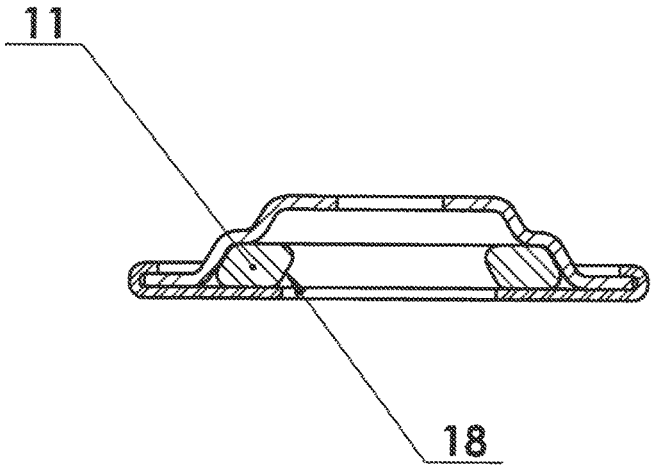
FIG. 8 shows a modified embodiment of the snap fastener of FIG. 1.

Thus, in particular, as shown in FIG. 8, the loop or ring element 11 has a slanted wall beveled portion 18 to facilitate the engagement of the snap fastener male part.

Moreover, the ring or loop element 11 may also be made in different configurations, depending on corresponding configurations of the chamber 10 of the snap fastener female part body 9, as is shown, for example, in the accompanying FIGS. 9 and 10.

The invention claimed is:

1. A snap fastener, of a type comprising a female part (2) including a circular ring-shaped spring (11, 11*a*, 11*b*) having a circular inner hole (20) and a male part (4) having a male part stem (5) for engaging with said circular ring-shaped spring made of plastic material, said circular ring-shaped spring (11,11*a*,11*b*) comprises a slanted wall beveled portion (18) on said inner hole (20) that facilitates the engagement of the snap fastener male part (4) with said female part (2), characterized in that said snap fastener further comprises engagement means having different resistance to with differentiated buttoning and unbuttoning efforts, between said stem (5) and said circular ring-shaped spring (11,11*a*,11*b*), said engagement means comprising a chamber (10, 10*a*, 10*b*) provided inside said female part (2) for housing said circular ring-shaped spring (11, 11*a*, 11*b*), said chamber (10, 10*a*, 10*b*) further having a longer chamber shoulder (12, 12*a*, 12*b*) on a buttoning side of said female part (2), said longer chamber shoulder having a first length (L1) longer than a second length (L2) of a corresponding shorter chamber shoulder (13, 13*a*, 13*b*) arranged on an opposite side to said buttoning side of said female part (2), said longer chamber shoulder (12, 12*a*, 12*b*) provides said circular ring-shaped spring (11, 11*a*, 11*b*) with a corresponding shorter spring free portion (15, 15*a*, 15*b*) as compared to a corresponding longer spring free portion (14,14*a*,14*b*) of said circular ring-shaped spring (11, 11*a*,11*b*) whereby said shorter spring free portion (15, 15*a*, 15*b*) of said circular ring-shaped spring (11, 11*a*, 11*b*) provides an enhanced resistance against unbuttoning, and said circular ring-shaped spring (11, 11*a*, 11*b*) having a corresponding longer spring free portion (14, 14*a*, 14*b*), which deforms as said stem (5) engages said female part (2) and facilitates engagement of said female part (2) by a longer length of said longer spring free portion (14, 14*a*, 14*b*) of said circular ring-shaped spring (11, 11*a*, 11*b*.

2. A snap fastener, according to claim 1, characterized in that said female part (2) comprises two female bodies (2*a*, 2*b*), each said female body defining in turn an inner chamber (10*a*, 10*b*) for housing a corresponding circular ring-shaped spring (11*a*, 11*b*).

3. A snap fastener, according to claim 2, characterized in that said chambers (10*a*, 10*b*) comprise chamber shoulders having different lengths, namely longer chamber shoulders (12*a*, 12*b*) on the buttoning side and shorter chamber shoulders (13*a*, 13*b*) on an opposite side, respectively.

4. A snap fastener, according to claim 3, characterized in that said circular ring-shaped springs (11*a*, 11*b*) comprise longer spring free portions (14*a*, 14*b*) and shorter spring free portions (15*a*, 15*b*), thereby an engagement of said stem (5) in said female bodies (2*a*, 2*b*) is facilitated by the longer length of said longer spring free portions (14*a*, 14*b*), the shorter spring free portions (15*a*, 15*b*) of said circular ring-shaped springs (11*a*, 11*b*) on the stem (5) engagement side providing an enhanced resistance against unbuttoning.

5. A snap fastener, according to claim 1, characterized in that a third length (L3) of said circular ring-shaped spring (11) is substantially equal to said first length (L1) of said longer chamber shoulder (12) of the chamber (10) of the body (9) of the snap fastener female part (2) and projects from said longer chamber shoulder (12) only at an edge (19) of the circular inner hole (20) of said circular ring-shaped spring (11) wherein the third length (L3) is measured from an outer edge of said circular ring spring (11) to the edge (19) of the circular inner hole (20) of said circular ring-shaped spring (11).

* * * * *